US007521853B2

(12) United States Patent
Oh et al.

(10) Patent No.: US 7,521,853 B2
(45) Date of Patent: Apr. 21, 2009

(54) SHADOW MASK FOR CATHODE RAY TUBE

(75) Inventors: Hyung-Seok Oh, Suwon-si (KR); Jong-Heon Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 507 days.

(21) Appl. No.: 11/294,352

(22) Filed: Dec. 6, 2005

(65) Prior Publication Data

US 2006/0138929 A1 Jun. 29, 2006

(30) Foreign Application Priority Data

Dec. 7, 2004 (KR) ..... 10-2004-0102270

(51) Int. Cl.
*H01J 29/80* (2006.01)

(52) U.S. Cl. ..... 313/402; 313/477 R

(58) Field of Classification Search ..... None
See application file for complete search history.

(56) References Cited

U.S. PATENT DOCUMENTS 4,881,004 A * 11/1989 Inoue et al. ..... 313/408
2002/0109451 A1* 8/2002 Nakagawa et al. ..... 313/402

FOREIGN PATENT DOCUMENTS

| | | |
|---|---|---|
| JP | 2001-126632 | 5/2001 |
| KR | 10-1989-0004377 | 4/1989 |
| KR | 10-2002-0085521 | 11/2002 |

* cited by examiner

*Primary Examiner*—Ashok Patel
(74) *Attorney, Agent, or Firm*—Robert E. Bushnell, Esq.

(57) ABSTRACT

A shadow mask for a cathode ray tube is formed with a curved surface such that a radius of curvature corresponding to a perpendicular axis which passes through the center of the shadow mask decreases monotonely along the perpendicular axis from the center of the shadow mask and a radius of curvature corresponding to a parallel axis which passes through the center of the shadow mask decreases monotonely along the parallel axis from the center of the shadow mask. The curved surface satisfies the following condition, $[0.1RV_{min}+0.9RV_{max}, \quad 0.9RV_{min}+0.1RV_{max}] \subset [RH_{min}, RH_{max}]$. $RV_{min}$ and $RV_{max}$ respectively represent the minimum and the maximum value of the minimum radius of curvature corresponding to the perpendicular axis, and $RH_{min}$ and $RH_{max}$ respectively represent the minimum and the maximum value of the minimum radius of curvature corresponding to the parallel axis.

14 Claims, 2 Drawing Sheets

SHADOW MASK FOR CATHODE RAY TUBE

CLAIM OF PRIORITY

This application makes reference to, incorporates the same herein, and claims all benefits accruing under 35 U.S.C. §119 from an application for SHADOW MASK FOR CATHODE RAY TUBE earlier filed in the Korean Intellectual Property Office on 7 Dec. 2004 and there duly assigned Serial No. 10-2004-0102270.

BACKGROUND OF THE INVENTION

1. Field of the Invention

The present invention relates to a shadow mask for a cathode ray tube, and in particular, to a shadow mask for a cathode ray tube that defines a range of the minimum radius of curvature to improve properties in shock and howling simultaneously.

2. Description of the Related Art

Generally, a cathode ray tube is an electronic tube where electron beams emitted from an electron gun are deflected due to a magnetic deflection field, pass through a color selection shadow mask, and then strike and excite green, blue, and red phosphors on a phosphor film within a panel, thereby displaying desired images.

The shadow mask has a color selection function of selecting the emitted electron beams and landing them on the phosphor film.

The shape of the shadow mask is determined according to size and shape of a panel, that is, a front plane glass of the cathode ray tube. The shadow mask is formed with a radius of curvature of about R=2000 mm (millimeters) generally.

Recently, cathode ray tubes have become larger, and the front surface of the panel has been flattened. Accordingly, the shape of the shadow mask has changed to correspond to these tendencies of the cathode ray tube.

However, when the shadow mask has a large size and a large radius of curvature, the structural strength of the shadow mask becomes poor, and this may induce many problems.

That is, when the radius of curvature of the shadow mask is 1.6R or more, the shadow mask cannot maintain its own shape due to shocks from the outside. Deformation of the shadow mask deteriorates the quality of the cathode ray tube.

In addition, when the shadow mask has a large size and a large radius of curvature, it has poor properties in howling. That is, when the cathode ray tube with the shadow mask is used as a television, the shadow mask trembles due to the sound of the television. In this case, the shadow mask becomes fragile by the howling phenomenon due to the weakness of the structural strength.

When the outer surface of the panel is formed with a flat shape and has a large inner radius of curvature, the radius of curvature of the shadow mask also increases. Accordingly, the shadow mask becomes flat.

When the curved plane of the shadow mask becomes partially flat, deformations occur in the flat portion of the curved plane due to the shock load from the outside.

As the shock load is applied continually, the deformations are transferred to the edge portions of the shadow mask. Accordingly, plastic deformations occur in the shadow mask, and the electron beams emitted from the electron gun are distorted during passing through the shadow mask. Accordingly, the electrons cannot cause correct emission of the phosphors, and trembling of the images and deterioration of color purity occurs.

SUMMARY OF THE INVENTION

It is an object of the present invention to provide a shadow mask for a cathode ray tube that can improve shock and howling properties by defining a range of the radius of curvature according to the perpendicular and parallel axis.

It is another object of the present invention to provide a shadow mask having larger resonance frequency values and much smaller maximum amplitude values corresponding to each of the resonance frequencies than the shadow mask according to the prior art.

It is yet another object to provide a shadow mask according to the present invention that is applied for use in a cathode ray tube involving a wide-angled deflection angle to make it slimmer, the shadow mask exhibiting enhanced effects.

A shadow mask for a cathode ray tube according to an exemplary embodiment of the present invention, is formed with a curved surface such that a radius of curvature corresponding to a perpendicular axis which passes through a center of the shadow mask monotonely decreasing along the perpendicular axis from the center of the shadow mask and a radius of curvature corresponding to a parallel axis which passes through the center of the shadow mask monotonely decreasing along the parallel axis from the center of the shadow mask, and the curved surface satisfies the following condition:

$$[0.9RV_{min}+0.1RV_{max}, 0.1RV_{min}+0.9RV_{max}] \subset [RH_{min}, RH_{max}]$$

wherein RVmin and RVmax respectively represent the minimum and the maximum value of the minimum radius of curvature corresponding to the perpendicular axis, and $RH_{min}$ and $RH_{max}$ respectively represent the minimum and the maximum value of the minimum radius of curvature corresponding to the parallel axis.

In addition, in the case that the cathode ray tube has an aspect ratio of 16:9, the curved surface may decrease monotonely from a diagonal of an effective screen portion to the ⅓ point of the long side portion of the shadow mask, and may satisfy the following condition:

$$RE_{max}<RV_{min}$$

wherein $RE_{max}$ represents the maximum value of the minimum radius of curvature in the part from the diagonal of the effective screen portion to the ⅓ point of the long side portion.

With the above structure, since the maximum amplitude is decreased, the mask shadow according to the present invention can improve howling properties.

In addition, since deformation energy which affects the strength is distributed uniformly, the shadow mask according to the present invention can improve shock properties.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The present invention will be described more fully hereinafter with reference to the accompanying drawings, in which a certain exemplary embodiment of the present invention is shown.

Figure 1:
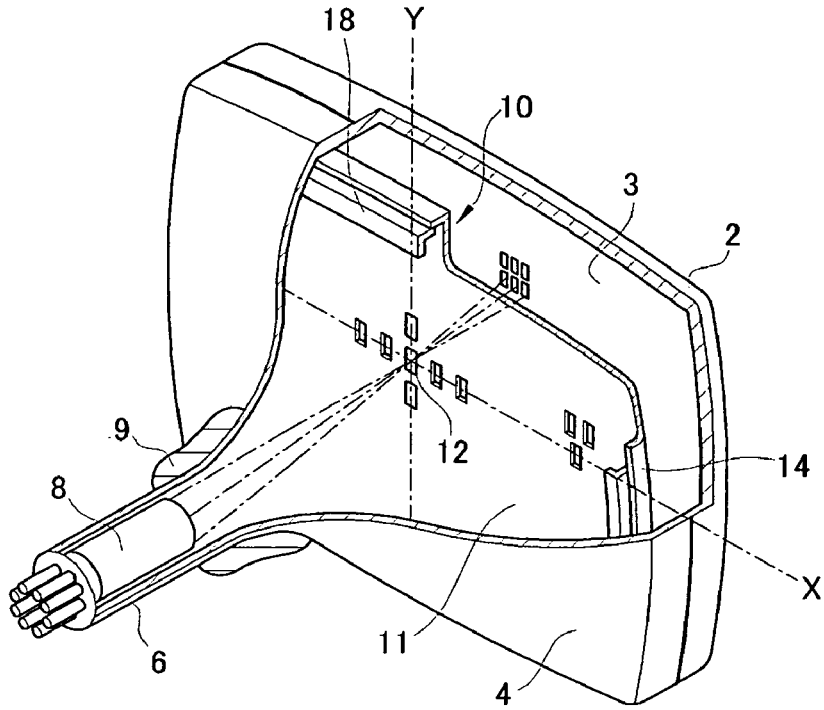
FIG. 1 is a partial sectional perspective view of a cathode ray tube adopting the mask assembly according to an exemplary embodiment of the present invention.
Figure 2:
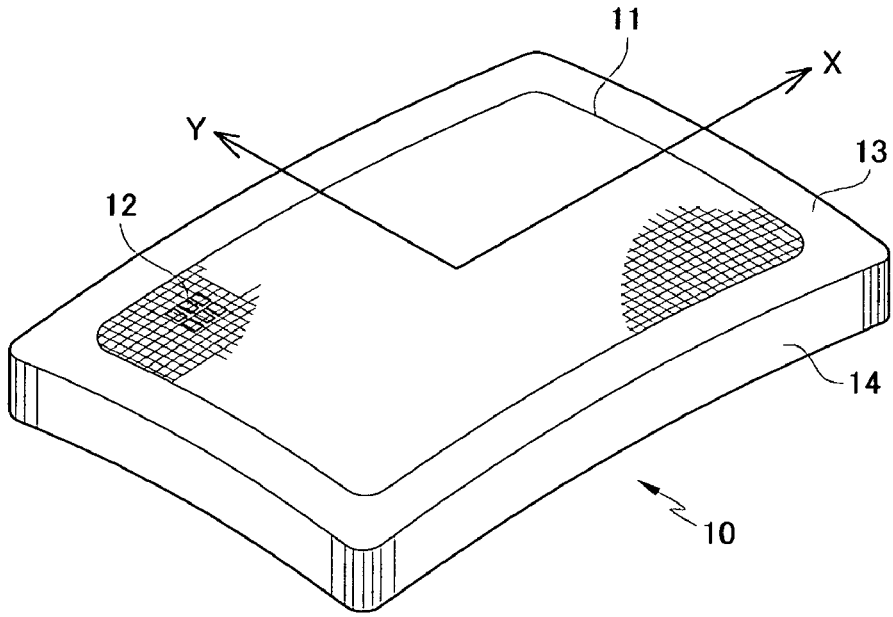
FIG. 2 is a perspective view of a shadow mask for a cathode ray tube according to the exemplary embodiment of the present invention.

As shown in FIGS. 1 and 2, a cathode ray tube with a shadow mask according to an embodiment of the present invention is formed with a vacuum vessel having a panel 2, a funnel 4, and a neck 6, and an electron gun 8 and a deflection yoke 9 are installed at the vacuum vessel.

A phosphor film 3 is formed on the inner surface of the panel 2 with red R, green G, and blue B phosphors patterned while interposing a black matrix BM.

The electron gun 8 is mounted within the neck 6 to emit electrons, and the deflection yoke 9 is mounted around the outer circumference of the funnel 4 to deflect the electron beams emitted from the electron gun 8.

The panel 2, the funnel 4, and the neck 6 are integrated into one body to thereby form a vacuum vessel.

A shadow mask 10 is installed at the panel 2 such that it is spaced apart from the phosphor film 3 with a predetermined distance while being supported by a frame 18.

In addition, the shadow mask 10 has an effective screen portion 11 having beam passage holes 12 and practically serving to display the desired images, and a non-holed portion 13 having no beam-passage holes 12 and not serving to display the images.

The effective screen portion 11 is completely surrounded by the non-holed portion 13.

The shadow mask 10 has a skirt portion 14 bent from the edge of the non-holed portion 13 toward the frame 18 to fix the shadow mask 10 to the frame 18.

With the cathode ray tube, the electron beams emitted from the electron gun 8 are deflected due to the deflection magnetic field of the deflection yoke 9, and pass through the beam passage holes 12 of the color selection shadow mask 10. The electron beams then collide against the green, blue, and red phosphors of the phosphor film 3 formed on the inner surface of the panel 2. Consequently, the phosphors are excited to thereby display the desired images.

The shadow mask 10 has a radius of curvature corresponding to a perpendicular axis Y and to a parallel axis X which pass through the center of the shadow mask 10.

The radius of curvature corresponding to the perpendicular axis Y decreases monotonely along the perpendicular axis Y from the center of the shadow mask 10, and the radius of curvature corresponding to the parallel axis X decreases monotonely along the parallel axis X from the center of the shadow mask 10.

On moving from the center to the edge of the shadow mask 10 along the perpendicular axis Y, the radius of curvature corresponding to the perpendicular axis Y varies. And variation of the radius of curvature substantially exhibits a monotone decreasing function when it is expressed as a function.

In the same way, on moving from the center to the edge of the shadow mask 10 along the parallel axis X, the radius of curvature corresponding to the parallel axis X varies. And variation of the radius of curvature substantially exhibits a monotone decreasing function when it is expressed as a function.

That is, a polynomial expression such as a $4^{th}$ order equation is induced in such a way that the distance from an axis of the tube to the curved surface along the perpendicular axis Y and the parallel axis X at regular intervals such as 10 mm (millimeters), 5 mm, 1 mm and so on.

In the case that the polynomial expression forms a monotone decreasing function, the curved surface that is represented by the monotone decreasing function is said to decrease monotonely.

Further, the shadow mask 10 is formed with a curved surface which satisfies the following condition, $$[0.9RV_{min}+0.1RV_{max}, 0.1RV_{min}+0.9RV_{max}] \subset [RH_{min}, RH_{max}]$$

wherein $RV_{min}$ and $RV_{max}$ respectively represent the minimum and the maximum value of the minimum radius of curvature corresponding to the perpendicular axis Y, and $RH_{min}$ and $RH_{max}$ respectively represent the minimum and the maximum value of the minimum radius of curvature corresponding to the parallel axis X.

In the above, the minimum radius of curvature represents a radius of curvature which has a minimum value among the radii of curvature decreasing monotonely. The minimum values of the minimum radii of curvature are $RV_{min}$ and $RH_{min}$, and the maximum values of the minimum radii of curvature are $RV_{max}$ and $RH_{max}$.

The expression, $[0.9RV_{min}+0.1RV_{max}, 0.1RV_{min}+0.9RV_{max}] \subset [RH_{min}, RH_{max}]$ means that a set which is composed of two elements, $0.1RV_{min}$ and $0.9RV_{max}$, $0.9RV_{min}$ and $0.1RV_{max}$ is a subset of a set which is composed of two elements, $RH_{min}$, $RH_{max}$.

The expression is induced in such a way that multiple simulations were carried out and prototypes of shadow masks that satisfy the howling properties were made and tested and a relationship between the minimum radii of curvature were derived experimentally.

In the case that the aspect ratio is 16:9, the shadow mask 10 is formed with a curved surface which decreases monotonely from the diagonal of the effective screen portion 11 to the ⅓ point of the long side portion, and satisfies the following condition, $RE_{max}<R_{min}$ wherein $RE_{max}$ represents the maximum value of the minimum radius of curvature in the part from the diagonal of the effective screen portion 11 to the ⅓ point of the long side portion.

The diagonal of the effective screen portion 11 represents a direction of a diagonal of the effective screen portion 11, and the ⅓ point of the long side portion represents a point which is moved from the diagonal of the effective screen portion 11 to the center of the effective portion 11 as much distance as ⅓ of the length of the long side portion.

Figure 3:
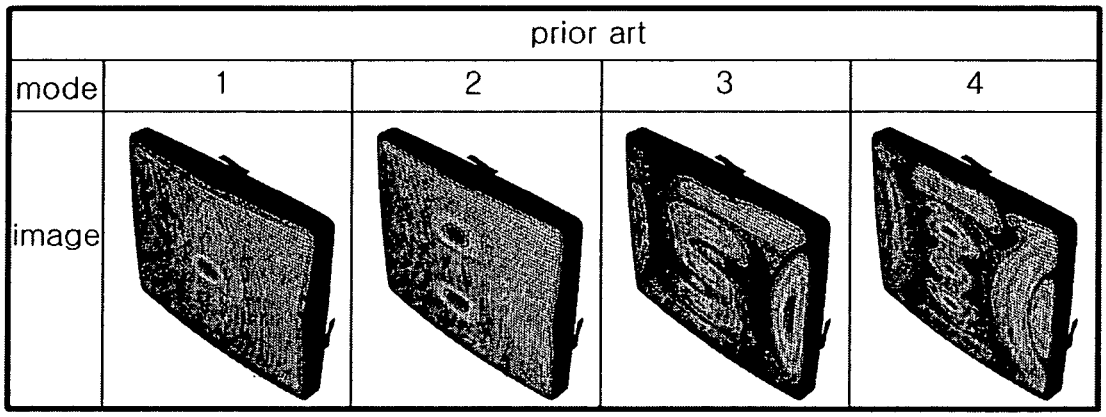
FIG. 3 is a simulation image of the distribution of the deformation energy in a shadow mask according to the prior art.
Figure 4:
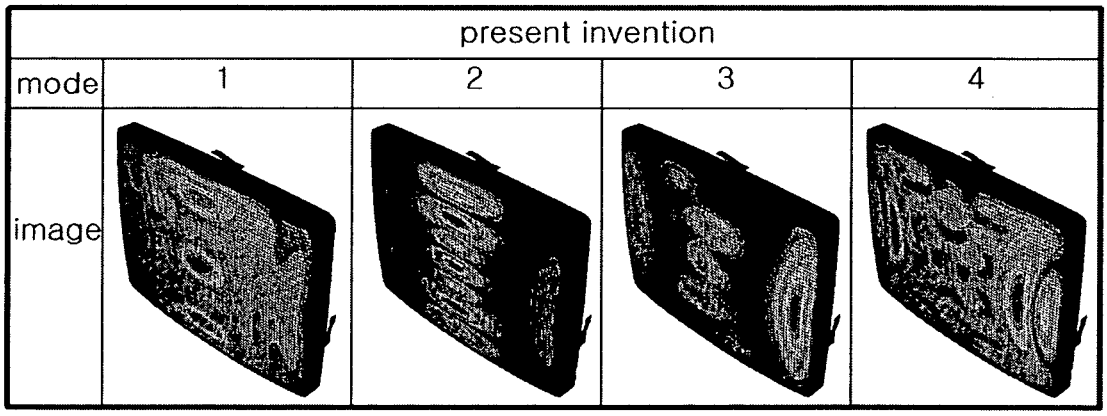
FIG. 4 is a simulation image of the distribution of the deformation energy in a shadow mask according to the shadow mask of the exemplary embodiment of the present invention.

FIG. 3 shows distribution of deformation energy which is simulated from the $1^{st}$ to the $4^{th}$ resonance modes in a shadow mask according to the prior art, and FIG. 4 shows distribution of deformation energy which is simulated from the $1^{st}$ to the $4^{th}$ resonance modes in the shadow mask according to the exemplary embodiment of the present invention.

As shown in FIGS. 3 and 4, the shadow mask according to the exemplary embodiment of the present invention has uniform distribution of the deformation energy in the 1st resonance mode in comparison with the prior art.

The following Table 1 shows comparison of the resonance frequencies in each of the $1^{st}$ to the $4^{th}$ resonance modes and the maximum amplitudes according to the resonance frequencies in a diagonal portion and a horizontal portion of the present invention and the prior art.

TABLE 1

| | Prior art | | | Present invention | | |
|---|---|---|---|---|---|---|
| | | Maximum amplitude | | | Maximum amplitude | |
| Resonance mode | Resonance frequency | diagonal portion | horizontal portion | Resonance frequency | diagonal portion | horizontal portion |
| $1^{st}$ | 0.58 | 0.88 | 1.00 | 0.66 | 0.38 | 0.46 |
| $2^{nd}$ | 0.80 | 0.29 | 0.25 | 0.81 | 0.10 | 0.13 |
| $3^{rd}$ | 0.87 | 0.38 | 0.25 | 0.90 | 0.17 | 0.25 |
| $4^{th}$ | 0.92 | 0.54 | 0.67 | 1.00 | 0.38 | 0.50 |

As shown in Table 1, the shadow mask according to the present invention has larger resonance frequency values and much smaller maximum amplitude values corresponding to each of the resonance frequencies than the shadow mask according to the prior art.

In the shadow mask according to the present invention, the conditions which determine the range of curvature are attained experimentally through multiple simulations and the making of various prototypes of shadow masks, with the results being shown in Table 1.

In the case that the shadow mask according to the embodiment of the present invention is applied for use in a cathode ray tube involving a wide-angled deflection angle of 115° or more (a conventional cathode ray tube involves a deflection angle of 102-106°) to make it slimmer, the shadow mask exhibits enhanced effects.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A shadow mask for a cathode ray tube, the shadow mask being formed with a curved surface comprising a radius of curvature corresponding to a perpendicular axis which passes through the center of said shadow mask monotonely decreasing along the perpendicular axis from a center of said shadow mask and a radius of curvature corresponding to a parallel axis which passes through the center of the shadow mask monotonely decreasing along the parallel axis from the center of said shadow mask, the curved surface satisfying the following condition:

$$[0.9RV_{min}+0.1RV_{max}, 0.1RV_{min}+0.9RV_{max}] \subset [RH_{min}, RH_{max}]$$

wherein $RV_{min}$ and $RV_{max}$ respectively represent the minimum and the maximum value of the minimum radius of curvature corresponding to the perpendicular axis, and $RH_{min}$ and $RH_{max}$ respectively represent the minimum and the maximum value of the minimum radius of curvature corresponding to the parallel axis.

2. The shadow mask for a cathode ray tube of claim 1, wherein the curved surface decreases monotonely from a diagonal of an effective screen portion to a ⅓ point of a long side portion of said shadow mask, and satisfies the following condition:

$$RE_{max}<RV_{min}$$

wherein $Re_{max}$ represents the maximum value of the minimum radius of curvature in the part from the diagonal of the effective screen portion to the ⅓ point of the long side portion.

3. A cathode ray tube, comprising:

a panel having a phosphor film on an inner surface of the panel;

a funnel connected to said panel;

a neck connected to said funnel;

an electron gun mounted within the neck to emit electron beams;

a deflection yoke mounted around the outer circumference of said funnel to deflect the electron beams emitted from said electron gun; and a shadow mask mounted within said panel to color-selectively pass the electron beams emitted from said electron gun, with said shadow mask being formed with a curved surface comprising a radius of curvature corresponding to a perpendicular axis which passes through a center of said shadow mask monotonely decreasing along the perpendicular axis from the center of said shadow mask and a radius of curvature corresponding to a parallel axis which passes through the center of said shadow mask monotonely decreasing along the parallel axis from the center of said shadow mask, and the curved surface satisfies the following condition:

$$[0.9RV_{min}+0.1RV_{max}, 0.1RV_{min}+0.9RV_{max}] \subset [RH_{min}, RH_{max}]$$

wherein $RV_{min}$ and $RV_{max}$ respectively represent the minimum and the maximum value of the minimum radius of curvature corresponding to the perpendicular axis, and $RH_{min}$ and $RH_{max}$ respectively represent the minimum and the maximum value of the minimum radius of curvature corresponding to the parallel axis.

4. The cathode ray tube of claim 3, wherein said panel has an aspect ratio of 16:9, and the curved surface satisfies the following condition:

$$RE_{max}<RV_{min}$$

wherein $RE_{max}$ represents the maximum value of the minimum radius of curvature in the part from the diagonal of the effective screen portion to the ⅓ point of the long side portion.

5. The cathode ray tube of claim 3, wherein the deflection angle of the electron beams deflected by the deflection yoke is at least 110°.

6. A shadow mask, comprising:

a curved surface of the shadow mask of a cathode ray tube, comprising:

a first radius of curvature corresponding to a first axis which passes through a center of said shadow mask, decreasing monotonely along the first axis from the center of said shadow mask; and a second radius of curvature corresponding to a second axis which passes through the center of said shadow mask decreasing monotonely along the second axis from the center of said shadow mask, with the second axis being perpendicular to the first axis; and said curved surface satisfying the following condition:

$$[(A^*RV_{min})+(B^*RV_{max}), (B^*RV_{min})+(A^*RV_{max})] \subset [RH_{min}, RH_{max}]$$

in which $RV_{min}$ and $RV_{max}$ respectively represent minimum and maximum values of a minimum radius of curvature corresponding to the first axis, and $RH_{min}$ and $RH_{max}$ respectively represent minimum and maximum values of a minimum radius of curvature corresponding to the second axis, the minimum radius of curvature representing a radius of curvature which has a minimum value among the radii of curvature decreasing monotonely corresponding to the respective axis, and A and B are real numbers less than or equal to one.

7. The shadow masks of claim 6, wherein the curved surface satisfying the condition of a set comprising [(a first minimum value of the minimum radius of curvature corresponding to the perpendicular axis)+(a second maximum value of the minimum radius of curvature corresponding to the perpendicular axis), (a second minimum value of the minimum radius of curvature corresponding to the perpendicular axis)+(a first maximum value of the minimum radius of curvature corresponding to the perpendicular axis)] being a subset of set comprising [a minimum value of the minimum radius of curvature corresponding to the parallel axis, a maximum value of the minimum radius of curvature corresponding to the parallel axis].

8. The shadow mask of claim 6, with A equal to 0.1 and B equal to 0.9.

9. The shadow mask of claim 6, with a distance from an axis of said cathode ray tube to the curved surface of said shadow mask along the first axis and the second axis being defined by a pattern of regular intervals.

10. The shadow mask of claim 6, with an aspect ratio of an effective screen portion being at least 16:9, said radius of the curved surface decreases monotonely along a direction of a diagonal of said effective screen portion from a terminal of the diagonal to a ⅓ point of the long side portion of said shadow mask.

11. The shadow mask of claim 10, with said curved surface satisfying the following condition: $RE_{max}<RV_{min}$, in which $RE_{max}$ represents a maximum value of minimum radius of curvature in a part from the diagonal of the effective screen portion to the ⅓ point of the long side portion, the diagonal of the effective screen portion represents the direction of the diagonal of the effective screen portion, and the ⅓ point of the long side portion represents a point which is moved from the terminal of the diagonal of the effective screen portion to the center of the effective portion as much distance as ⅓ of a length of the long side portion of the effective portion.

12. The shadow mask of claim 6, with the shadow mask performing a uniform distribution of deformation energy in a predetermined resonance mode.

13. The shadow mask of claim 6, with the shadow mask receiving electron beams having a deflection angle of at least 110°, with the electron beams being deflected by a deflection yoke of the cathode ray tube.

14. The shadow mask of claim 6, with the shadow mask receiving electron beams having a deflection angle of at least 115°, with the electron beams being deflected by a deflection yoke of the cathode ray tube.

* * * * *